US005584239A

United States Patent [19]

Yelczyn et al.

[11] Patent Number: 5,584,239

[45] Date of Patent: Dec. 17, 1996

[54] CRUSHER FOR METAL CANS

[76] Inventors: Lawrence Yelczyn; Michael Yelczyn, both of W6630 County Trunk E, Burnett, Wis. 53992

[21] Appl. No.: 568,626

[22] Filed: Dec. 7, 1995

[51] Int. Cl.[6] ..... B30B 9/32

[52] U.S. Cl. ..... 100/35; 100/293; 100/902

[58] Field of Search ..... 100/35, 233, 258 A, 100/280, 283, 293, 902

[56] References Cited

U.S. PATENT DOCUMENTS

| | | | |
|---|---|---|---|
| 3,009,414 | 11/1961 | Griemert | 100/902 |
| 3,777,659 | 12/1973 | McCarten | 100/902 |
| 3,780,647 | 12/1973 | Reimers | 100/902 |
| 4,088,072 | 5/1978 | Wittmeier | 100/902 |
| 4,197,796 | 4/1980 | Salatka | 100/902 |
| 4,498,385 | 2/1985 | Manley | 100/902 |
| 4,890,552 | 1/1990 | Yelczyn | 100/902 |
| 5,396,838 | 3/1995 | Casapulla | 100/283 |

FOREIGN PATENT DOCUMENTS

| | | | |
|---|---|---|---|
| 4122254 | 1/1993 | Germany | 100/902 |

*Primary Examiner*—Stephen F. Gerrity
*Attorney, Agent, or Firm*—Donald Cayen

[57] ABSTRACT

A can crusher has a handle that pivots about a first axis. A first plate is fixed to the handle. A bottom plate is movable along the handle. A rod rotates about a second axis in response to pivoting of the handle to move the second plate, guided by a carrier, toward the first plate and thereby crush a can between the plates. In a modified embodiment, the second plate tilts relative to the first plate in two steps as the bottom plate approaches the top plate.

23 Claims, 4 Drawing Sheets

CRUSHER FOR METAL CANS

BACKGROUND OF THE INVENTION

1. Field of the Invention

This invention pertains to compacting devices, and more particularly to apparatus for crushing metal cans.

2. Description of the Prior Art

Various equipment has been developed to compact empty metal food and beverage containers. Compacting the containers, which are usually in the form of hollow cylinders having top and bottom closures, is a highly desirable part of the container recycling process.

Compactors for food and beverage containers such as the ubiquitous steel or aluminum cans fall into two general categories. Compactors in the first category are designed to crush the cans in the direction parallel to their longitudinal axis. Examples of that type of compactor may be seen in U.S. Pat. Nos. 2,446,898; 3,780,647; 4,088,272; 4,168,661; 4,197,796; 4,212,242; 4,228,734; 4,301,722; 4,323,009; 4,333,395; 4,345,520; 4,345,518; 4,394,834; 4,459,908; 4,498,385; 4,550,658; 4,890,552; and DES. 282,076. U.S. Pat. No. 4,475,449 shows apparatus that squeezes a can laterally from opposite sides before it crushes the can axially. The use of the first category of compactors is generally limited to compacting cans made of aluminum.

For containers made of steel, the second category of compactors is usually necessary. Those compactors function to crush the cans in a direction transverse to their longitudinal axis. Examples of the second category of compactors are shown in U.S. Pat. Nos. 3,667,386; 4,291,618; 4,292,891; 4,333,397; 4,561,351; 4,653,398; and German patent 1,289,001.

U.S. Pat. No. 4,290,354 describes a compactor that is capable of crushing both steel and aluminum cans.

Despite the large number of can compactors available, there nevertheless is room for improvements to them.

SUMMARY OF THE INVENTION

In accordance with the present invention, a crusher for metal cans is provided that is elegant in its simplicity of structure and operation. This is accomplished by apparatus that includes a bottom plate that is forced toward a top plate in response to the pivoting of a handle.

One end of the handle is connected to a base for pivoting about a first axis. The other end of the handle has a hand grip. The top plate is rigidly fixed to the handle and lies in a plane that is generally perpendicular to the handle longitudinal axis. The bottom plate is joined to a carrier that is slidable along the handle. The carrier maintains the bottom plate parallel to and aligned with the top plate.

A rod has one end connected to the base for rotating about a second axis. The second end of the rod is rotatably connected to the carrier. In an alternate construction, the rod second end is rotatably connected to the bottom plate rather than to the carrier.

In operation, the handle is manually pivoted such that it is generally vertically above the first axis. In that position, the carrier and the bottom plate are near the base. The bottom plate is spaced from the top plate a distance sufficient to place a can between the plates. The handle is then pivoted by means of a force applied to its hand grip. As the handle pivots, the top plate swings in an arc that brings it closer to the second axis. Simultaneously, the rod rotates about the second axis and forces the bottom plate, guided by the carrier, along the handle toward the top plate. The dual motions of the pivoting handle and the rotating rod produce an over-center action on the top and bottom plates. The combination of the sliding carrier and the rotatable end connections of the rod keeps the bottom plate parallel to the top plate. As the bottom plate approaches the top plate, the can is partially crushed between them.

As the handle pivots to the end of its travel, the top plate approaches closest to the second axis. Simultaneously, the carrier and bottom plate approach the end of their travel along the handle toward the top plate. The result is that the handle and rod produce a nearly over-center condition on the top and bottom plates together with the creation of a large mechanical advantage between them. The can is thus completely crushed with only moderate effort applied on the handle grip. The crushing operation is completed when the handle is generally vertically below the first axis.

When the handle is returned back toward its vertically upright position, the carrier, together with the bottom plate, slides on the handle away from the top plate. As a result, the crushed can is released from between the plates and falls off them by gravity.

In a modified embodiment, the carrier is free to both slide along the handle and also to tilt relative to the handle. For that purpose, the carrier is equipped with a roller that rolls along the handle, and the rod first end is rotatably connected only to the base. The rod second end is rigidly attached to the bottom plate. If desired, the bottom plate can have a slightly creased working surface, and the top plate then has a complimentary creased working surface.

The modified crusher is operated by pivoting the handle to be vertically above the first axis. A can is placed on the slidable plate with its longitudinal axis perpendicular to the handle. As the handle is pivoted, the handle and rod start an over-center action as the carrier rolls along the handle toward the top plate.

It is a feature of the present invention that the roller joint between the carrier and the handle, and the rigid attachment between the rod and the bottom plate, cause the carrier and thus the bottom plate to tilt in a two-step movement relative to the top plate. At the initial pivoting of the handle, the free edge of the bottom plate approaches the top plate at a faster rate than the edge of the slidable plate adjacent the handle. As the handle approaches 90 degrees of pivoting, the bottom plate edge adjacent the handle approaches the top plate faster than the bottom plate free edge. When the handle has pivoted approximately 150 degrees, the over-center action of the handle and rod is completed, and the two plates are parallel and close to each other. The resulting large mechanical advantage enables the can to be completely crushed in a two-step process without excessive input force.

The method and apparatus of the invention, using a top plate fixed to a pivoting handle and a bottom plate joined to a carrier that slides along the handle thus crushes cans in a rapid and simple manner. The minimal number of components renders the crusher inexpensive as well as very efficient.

Other advantages, benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
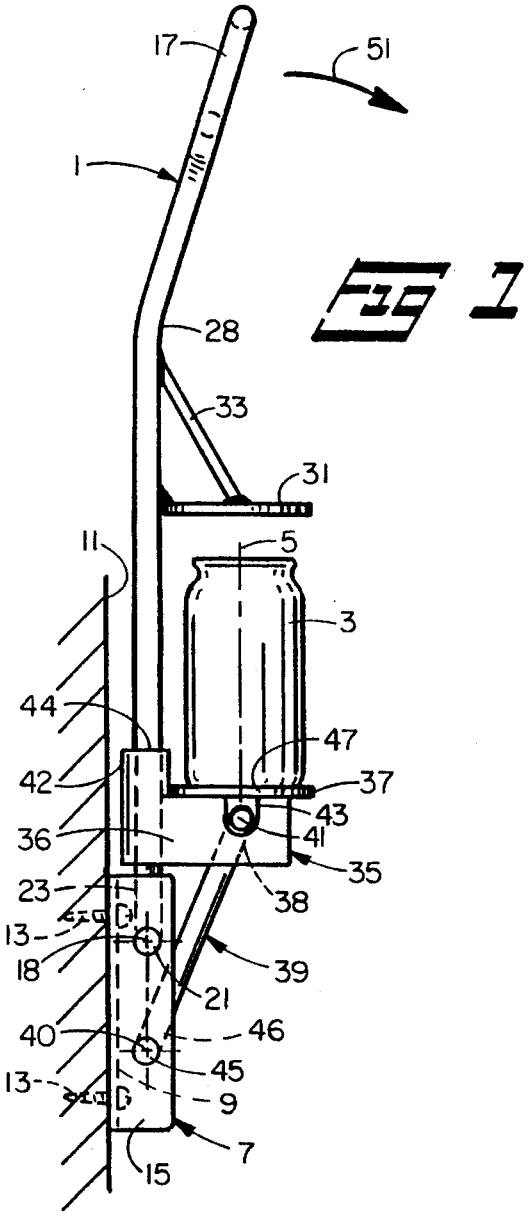
FIG. 1 is a side view of the invention showing it in an inoperative position ready to crush a can.
Figure 2:
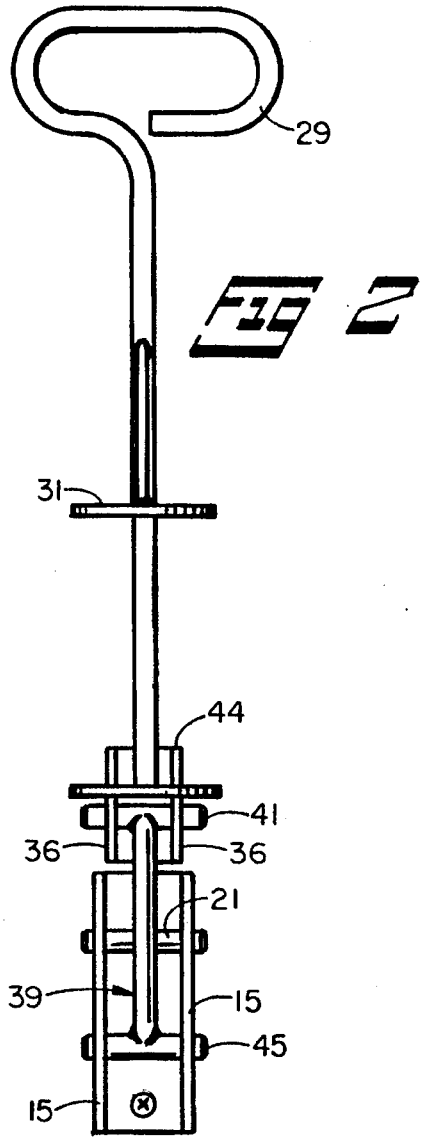
FIG. 2 is a front view of FIG. 1.

Referring to FIGS. 1 and 2, a crusher 1 for crushing metal cans 3 is illustrated that includes the present invention. The crusher 1 is especially suited for crushing aluminum beverage cans 3 axially along their longitudinal axis 5. For that purpose, the crusher has a base that is preferably in the form of a U-shaped channel 7. The base channel 7 has a back wall 9 and two parallel side walls 15. The back wall 9 of the base channel is mounted to a sturdy vertical surface 11 by conventional screws 13.

A long handle 17 has a first end 23 that is connected to the base channel 7 for pivoting about a first axis 18. The pivotal connection is achieved by means of a pin 21 welded or otherwise secured to the first end 23 of the handle 17. The pin 21 passes through the base channel side walls 15. The handle is angled at reference numeral 28. The handle terminates in a hand grip 29.

A flat top plate 31 is fixed, as by welding, to the handle 17 between its first end 23 and the angle 28. The top plate 31 is on the side of the handle opposite the mounting surface 11 when the handle is vertically above the base channel 7. The top plate lies in a plane that is perpendicular to the handle longitudinal axis. A strut 33 may be used to reinforce the top plate to the handle.

A carrier 35 is slidable on the handle 17 between its first end 23 and the top plate 31. In the illustrated construction, the carrier 35 is in the form of a shackle having parallel side arms 36 and a bend 42. The shackle receives the handle near its bend 42. The shackle side arms 36 have respective surfaces 47 that are recessed from the shackle upper end 44. A bottom plate 37 is joined to the shackle recessed surfaces 47. The bottom plate 37 cooperates with the shackle to capture and guide the shackle and bottom plate on the handle. The bottom plate lies directly under and parallel to the top plate 31.

The upper end 38 of a rod 39 is rotatably connected to the carrier 35. In the particular construction illustrated, the rotatable connection is in the form of a pair of short pins 41 welded to the rod upper end 38. The pins extend transversely through slots 43 in the shackle arms 36.

The lower end 46 of the rod 39 rotates about a second axis 40. For that purpose, a pin 45 is welded to the rod lower end 46. The pin 45 passes loosely through the side walls 15 of the base channel 7.

Figure 3:
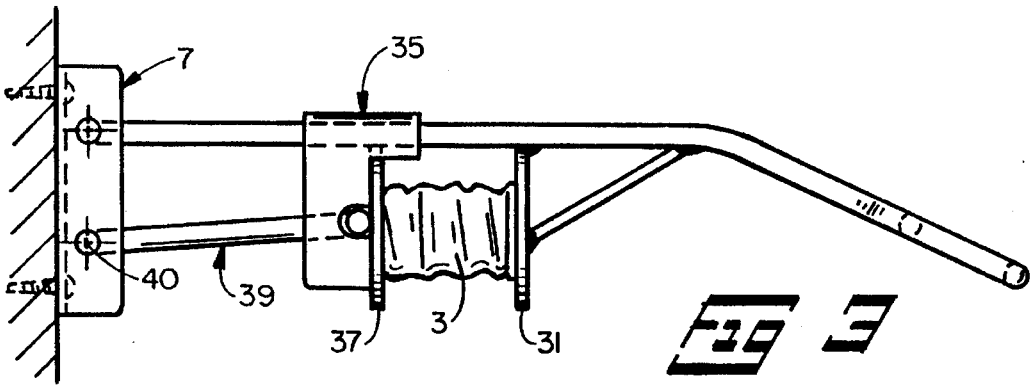
FIG. 3 is a side view of the crusher shown in an operative position in which the can is partially crushed.

In operation, the crusher 1 is placed in the position shown in FIGS. 1 and 2. That is, the handle 17 is pivoted such that it is substantially vertically above the base channel 7 and the first axis 18. In that situation, the top plate 31 is at a maximum distance from the second axis 40, and there is ample room between the top plate 31 and the bottom plate 37 for a can 3 to be placed on the bottom plate. The handle is then pivoted in the direction of arrow 51 toward the crusher position of FIG. 3. That action causes the top plate 31 to swing in an arc that brings it closer to the second axis 40. Simultaneously, the rod 39 rotates about the second axis 40. The combination of the pivoting of the handle and the rotation of the rod forces the bottom plate away from the handle first end 23 and toward the top plate. The bottom plate is guided by the carrier 35 as the carrier slides along the handle. The relative motion of the handle and rod produces an over-center action on the top and bottom plates. As the handle is further pivoted and the bottom plate approaches the top plate, the mechanical advantage between the plates progressively increases. The can is partially and easily crushed between the two plates. The rotary connections of the rod 39 with the carrier and the base channel 7 enable the bottom plate to remain parallel to the top plate.

Figure 4:
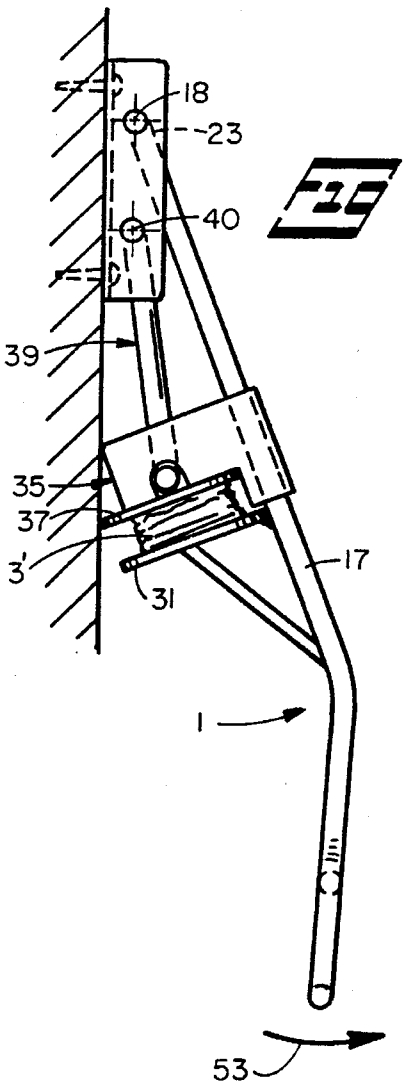
FIG. 4 is a side view showing the crusher in an operative position with the can fully crushed.
Figure 9:
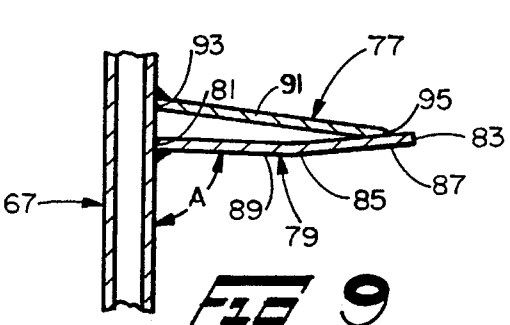
FIG. 9 is a cross sectional view taken along line 9—9 of FIG. 8.
Figure 10:
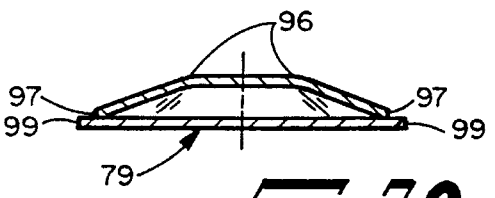
FIG. 10 is a cross sectional view taken along line 10—10 of FIG. 7.

Continued pivoting of the handle 17 in the direction of arrow 51 eventually results in the position of the crusher 1 shown in FIG. 4. At that position, the top plate 31 is at its closest location to the second axis 40. Also, the rod 39 has forced the bottom plate 37 close to the top plate 31. At that point, the over-center action of the handle and rod creates a very large mechanical advantage between the plates. As a result, the can 3' is crushed flat between the plates with a relatively small force exerted on the handle grip 29.

From the position of FIG. 4, the handle 17 is pivoted in the reverse direction, that is, in the direction of arrow 53. That pivoting causes the rod 39 to pull the carrier 35 and slide it, together with the bottom plate 37, along the handle back toward the handle first end 23 and away from the top plate 31. Consequently, the crushed can 3' is released from between the two plates and falls by gravity into a waiting container, not shown, located beneath the crusher 1. Pivoting the handle back to the position of FIGS. 1 and 2 readies it for accepting and crushing another can 3.

Figure 6:
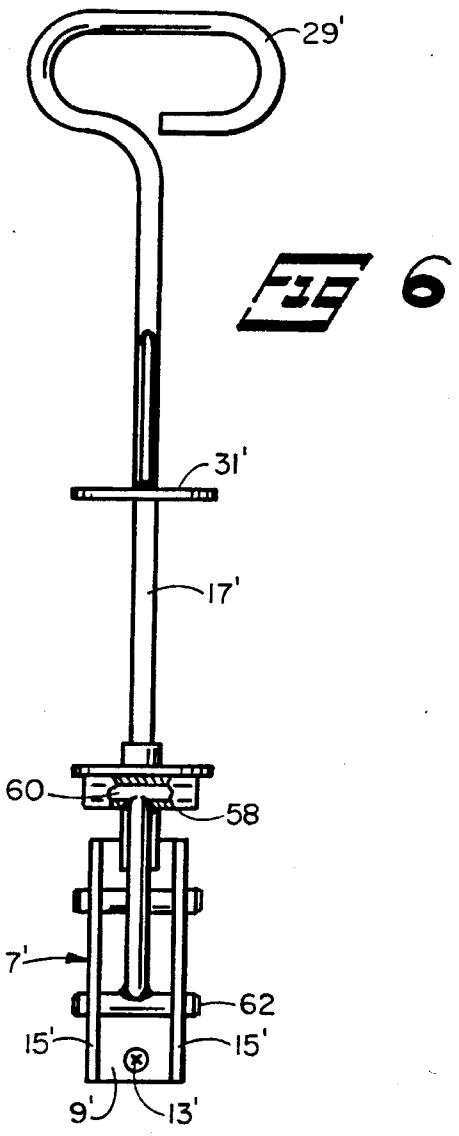
FIG. 6 is a front view of FIG. 5.
Figure 5:
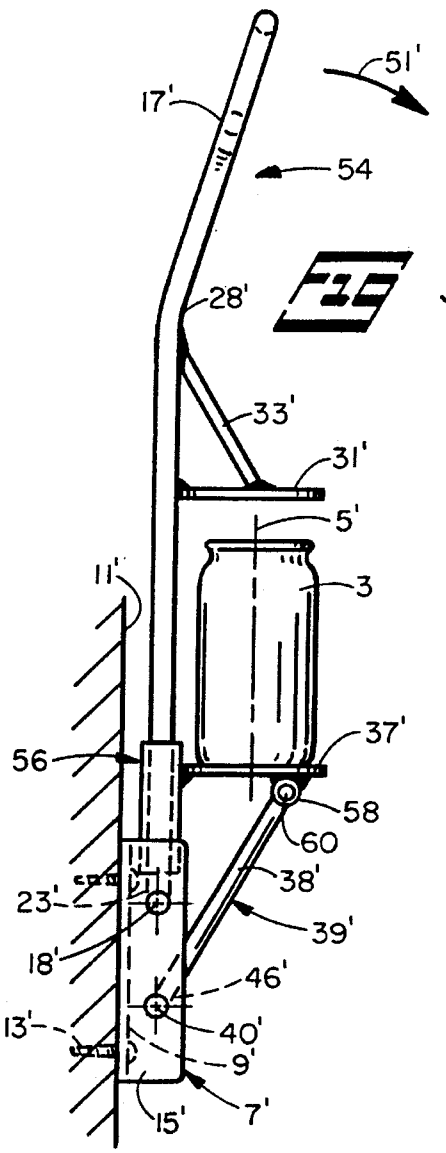
FIG. 5 is a view similar to FIG. 1, but showing an alternate construction of the invention.

FIGS. 5 and 6 show a can crusher 54 having an alternate construction for the carrier. The carrier 56 of the crusher 54 is in the form of a tubular sleeve that is slidable over the handle 17'. The bottom plate 37' is welded to the sleeve 56. The rotatable connection at the upper end 38' of the rod 39' is by means of a pair of short tubes 58 welded to the bottom plate 37'. The tubes 58 serve as journals for a pin 60 that is welded to the upper end 38' of the rod 39'. The second end 46' of the rod 39' has a pin 62 welded to it that passes through the walls 15' of the base channel 7'. The remainder of the construction of the can crusher 54 as well as its operation are substantially identical to that of the can crusher 1 described previously in conjunction with FIGS. 1–4.

Further in accordance with the present invention, a modified crusher 55 for metal cans is shown in FIGS. 7–11. The modified crusher 55 is designed to crush steel cans, even those with their ends in place, with minimum effort. The crusher 55 has a base in the form of a channel 57. A back wall 59 of the base channel 57 is mounted to a vertical surface 61 by screws 63. The base channel has two parallel side walls 65.

A long handle 67 is preferably made of a square tube. A bushing 69 is welded to the first end 71 of the handle 67. The handle is pivotally connected to the base channel 57 by a carriage bolt 73 passing through the base channel side walls 65 and through the handle bushing 69. The carriage bolt 73 and bushing 69 define a first axis 74. The handle is angled at reference numeral 75. The handle terminates in a hand grip 75. The hand grip 75 may be a round bar appropriately bent and welded to the end of the handle square tube.

A top plate 77 is fixed to the handle 67 between its first end 71 and the angle 75. In the preferred embodiment, the top plate 77 is comprised of two components. The first component is an upper contact plate 79 having an inside edge 81 and an outside edge 83. The upper contact plate 79 is creased at reference numeral 85 such that the working surface 87 thereof is convex. The inside edge 81 of the upper contact plate is welded to the handle. The angle A between the handle and the portion 89 of the working surface 87 between the crease 85 and the inside edge 81 is approximately 85 degrees.

The second component of the top plate 77 is an upper reinforcement plate 91. The upper reinforcement plate 91 has an inside edge 93 that is welded to the handle 67 a short distance from the upper contact plate 79. The upper reinforcement plate has an outer edge 95 that is welded to the upper contact plate near its outer edge 83. The upper reinforcement plate is bent along lines 96 so as to enable its two side edges 97 to be welded to respective side edges 99 of the upper contact plate.

The crusher 55 further comprises a bottom plate 101 that is movable along the handle 67 between the handle first end 71 and the top plate 77. The bottom plate 101 has a lower contact plate 103 that is creased so as to be complimentary to the upper contact plate 79. The lower contact plate 103 has an inside edge 104 and an outside edge 106. A lower reinforcement plate 105 has opposite edges 107. The lower reinforcement plate 105 is bent at reference numeral 109 between the edges 107. The edges 107 are welded to the lower contact plate at short distances from its inside and outside edges 104 and 106, respectively.

Figure 11:
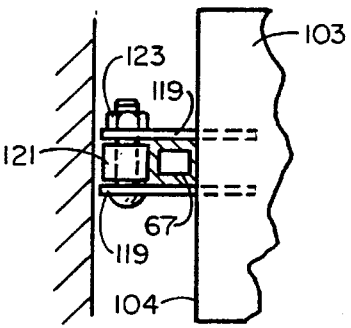
FIG. 11 is a cross sectional view taken along line 11—11 of FIG. 7.

The bottom plate 101 is movable along the handle 67 by means of a carrier 111. In the illustrated construction, the carrier 111 includes two parallel lugs 119 welded to the bottom plate lower contact plate 103 near its inside edge 104. The lugs 119 straddle the handle 67, as best shown in FIG. 11. A roller 121 is held between the two lugs and against the handle by a carriage bolt and nut 123.

A rod 113 has a first end 125 that is rigidly attached, as by welding, to the lower reinforcement plate 105 of the bottom plate 101. A bushing 127 is welded to the second end of the rod. A carriage bolt and nut 129 rotatably connect the rod bushing 127 between the side walls 65 of the base channel 57. The bushing 127 and carriage bolt 129 define a second axis 130.

Figure 8:
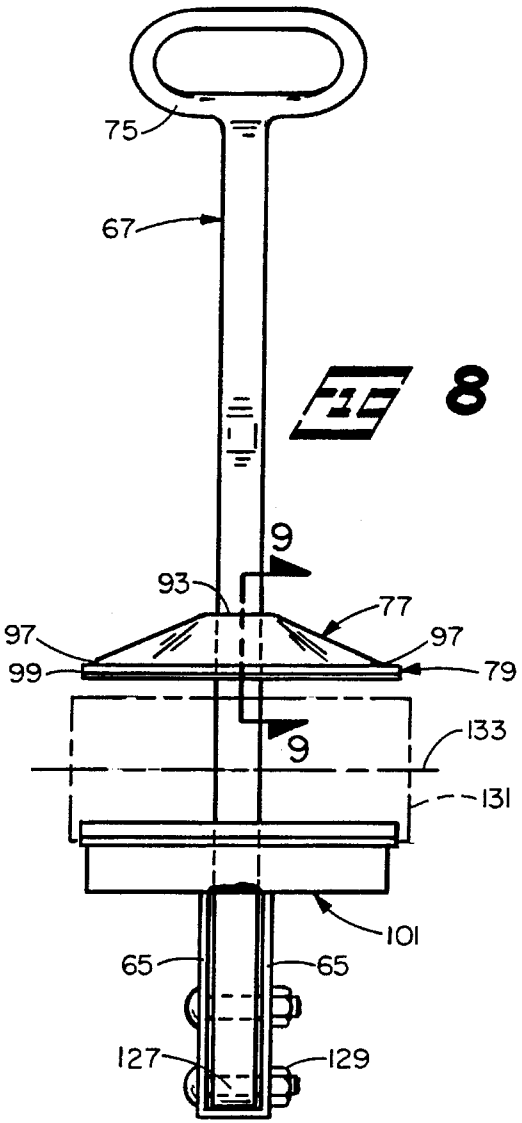
FIG. 8 is a front view of FIG. 7.
Figure 7:
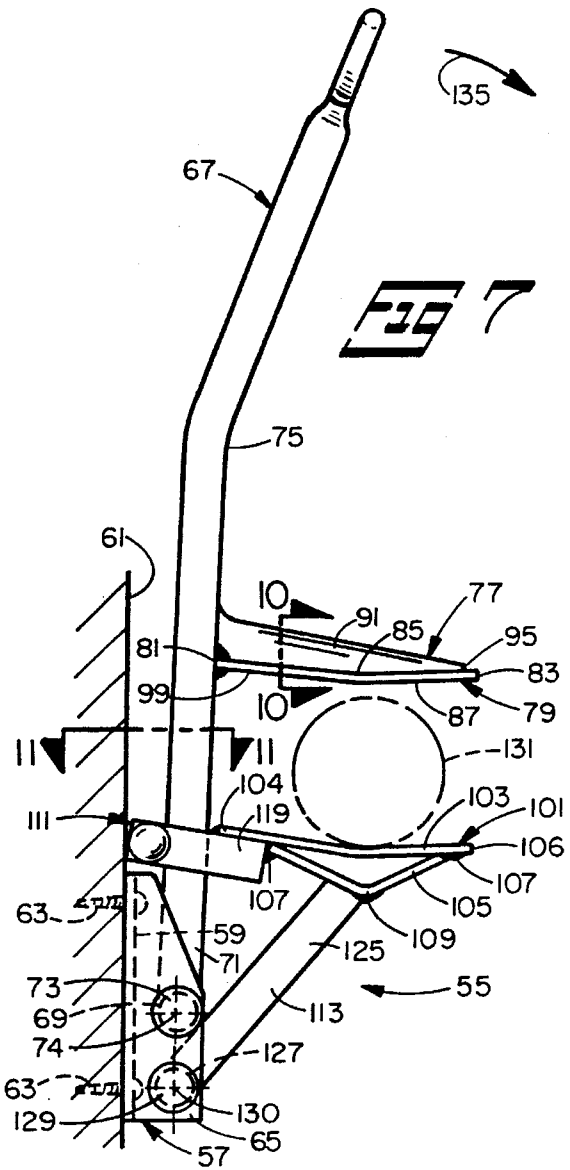
FIG. 7 is a side view of a modified embodiment of the invention.

The crusher 55 is used by pivoting the handle 67 to be approximately vertical above the first axis 74, FIGS. 7 and 8. In that position, the top plate 77 is at a maximum distance from the second axis 130. The top plate and bottom plate 101 are far enough apart to enable a steel can 131 to be placed on the bottom plate with the can longitudinal axis 133 horizontal. The handle is pivoted clockwise with respect to FIG. 7 in the direction of arrow 135 toward the position shown in FIG. 12. As the handle pivots, the rod 113 rotates about the carriage bolt 129. The handle and rod cooperate to start an over-center action. Accordingly, the rod forces the bottom plate along the handle toward the top plate. The roller 121 provides low friction movement of the lower plate.

Figure 12:
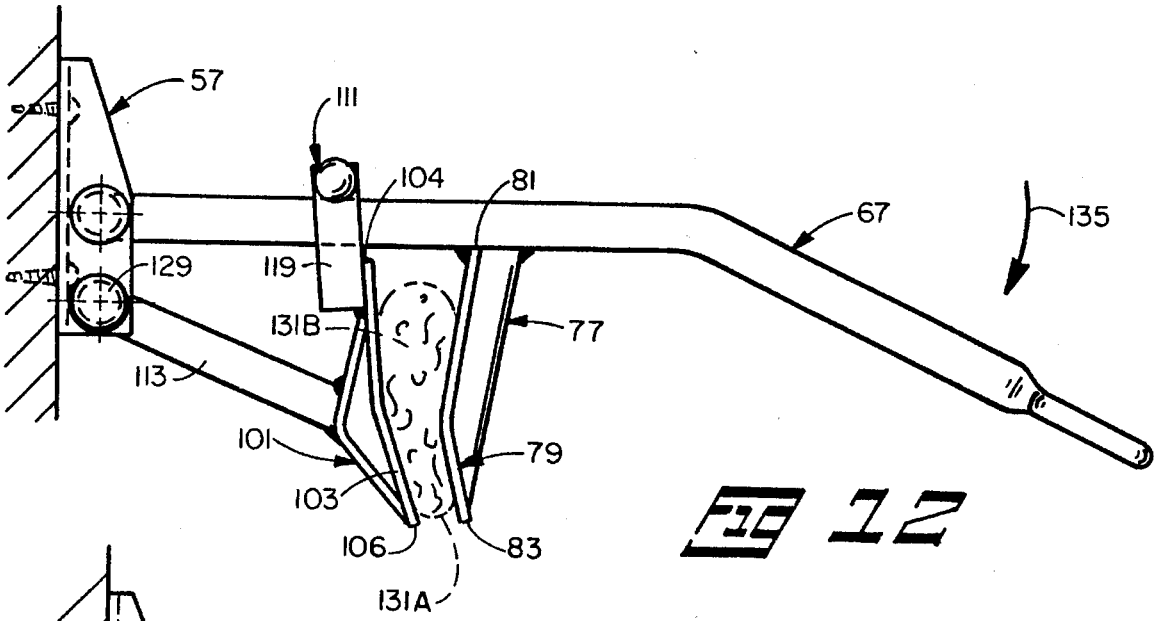
FIG. 12 is a side view of the crusher of FIGS. 7 and 8 showing it at a first step in the crushing of a can.

It is a feature of the present invention that the bottom plate 101 does not slide along the handle 67 and approach the top plate 77 with a uniform motion. Rather, the bottom plate approaches the top plate in two distinct steps. During the first step, as shown in FIG. 12, the outside edge 106 of the bottom plate lower contact plate 103 approaches the outside edge 83 of the top plate upper contact plate 79 faster than the inside edge 104 of the bottom plate lower contact plate approaches the inside edge 81 of the top plate upper contact plate. The uneven approach of the bottom plate toward the top plate is achieved by the combination of the roller carrier 111 of the bottom plate on the handle, the rotatable connection of the rod 113 to the base channel 57, and the rigid connection of the rod to the bottom plate. The roller 121 guides the bottom plate along the handle but also allows tilting of the bottom plate relative to the handle and relative to the top plate as the rod 113 forces the bottom plate along the handle. As a result, the portion 131A of the can 131 near the outside edges 83 and 106 is initially crushed more than the can portion 131B.

Figure 13:
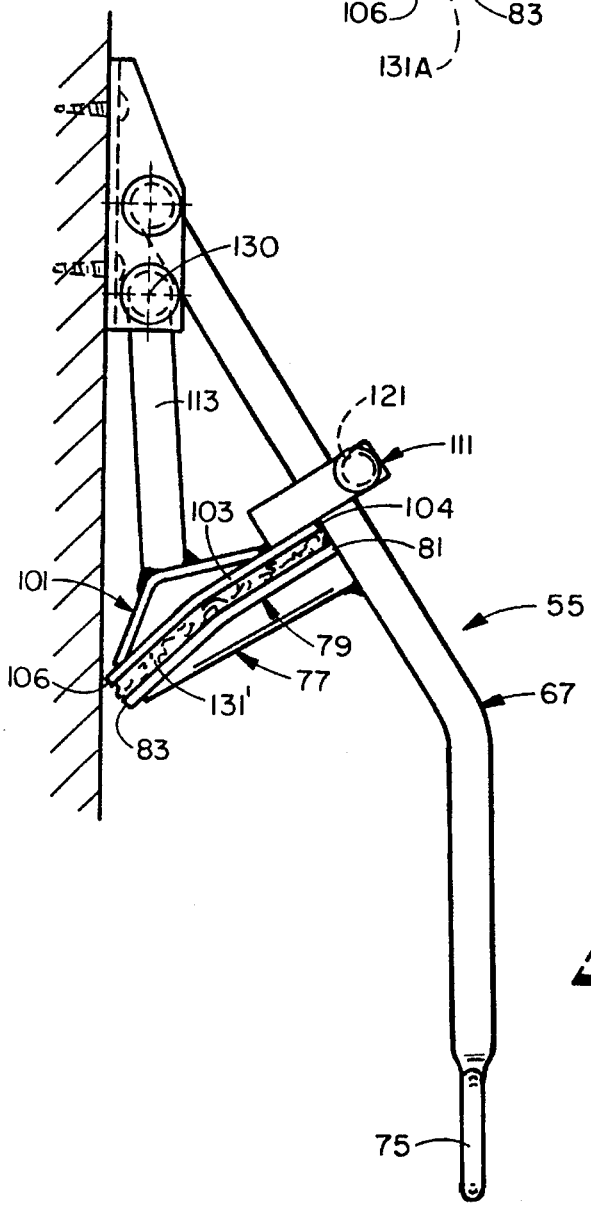
FIG. 13 is a view similar to FIG. 12, but showing the crusher at a second step in the crushing process.

Continued pivoting of the handle 67 eventually results in the crusher 55 attaining the position of FIG. 13. In that position, the top plate 77 is at its closest point to the second axis 130. Simultaneously, as the bottom plate 101 completes its approach toward the top plate, the bottom plate and carrier 111 are tilted by the rod 113 in the opposite direction relative to the handle. The second tilting is in a direction such that the inside edge 104 of the lower contact plate 103 approaches the inside edge 81 of the upper contact plate 79 faster than the outside edge 106 of the bottom plate lower contact plate approaches the outer edge 83 of the top plate upper contact plate. When the crusher has attained the position of FIG. 13, the over-center action of the handle and rod is completed, and the upper and lower contact plates are parallel. The resulting large mechanical advantage enables the can 131' to be crushed flat with only minimal force on the handle grip 75.

The two-step tilting of the bottom plate 101 as it approaches the top plate 77 is highly beneficial. The corresponding two-step crushing of the can 131 requires less force then crushing in a single step. Consequently, the force a person must exert on the handle grip 75 is relatively low for crushing steel cans.

In summary, the results and advantages of recycling metal cans can now be more fully realized. The crusher of the present invention provides both convenience and large forces for compacting cans. This desirable result comes from using the combined functions of the top plate that is fixed to the crusher handle and of the bottom plate that is movable along the handle. The bottom plate is forced toward the top plate by a rod that is rotatably connected to the same base as the handle. The handle and rod cooperate to produce an over-center action that creates a large mechanical advantage between the plates to crush the can between them. In one embodiment, the bottom plate approaches the top plate with a two-step tilting motion that crushes the cans in two steps. The two-step action requires less input force than if the can were crushed in a single step.

It will also be recognized that in addition to the superior performance of the present invention, its design and construction are such as to cost no more to manufacture than traditional crushers. Also, since the crusher is ruggedly built, the need for maintenance is minimal.

Thus, it is apparent that there has been provided, in accordance with the invention, a crusher for metal cans that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A crusher for metal cans comprising:

a. a base defining first and second axes;

b. an elongated handle having a first end connected to the base for pivoting between first and second positions about the base first axis, and a second end;

c. a top plate fixed to the handle, d. a bottom plate located between the handle first end and the top plate, the bottom plate being generally parallel to and aligned with the first plate;

e. rod means for rotating about the base second axis to force the bottom plate away from the handle first end and toward the top plate in response to pivoting of the handle from the first to the second positions thereof; and f. carrier means for guiding the bottom plate along the handle between the first end thereof and the top plate, so that the handle and rod means cooperate to produce an over-center action that crushes a can between the top and bottom plates when the handle is pivoted from the first to the second positions thereof.

2. The crusher for metal cans of claim 1 wherein the carrier means comprises a tubular sleeve that slides over the handle, the sleeve being joined to the bottom plate.

3. The crusher for metal cans of claim 2 wherein the rod means comprises a rod having a first end connected to the base for rotating about the base second axis, and a second end rotatably connected to the bottom plate.

4. The crusher for metal cans of claim 1 wherein:

a. the top plate comprises:

i. an upper contact plate having an inside edge fixed to the handle, an outside edge, and two side edges; and ii. an upper reinforcement plate having an inside edge fixed to the handle a predetermined distance from the upper contact plate, an outside edge joined to the outside edge of the upper contact plate, and side edges that are joined to the respective side edges of the upper contact plate;

b. the bottom plate comprises:

i. a lower contact plate having an inside edge and an outside edge; and ii. a lower reinforcement plate having an inside edge connected to the lower contact plate near the inside edge thereof, and an outside edge that is joined to the lower contact plate near the outside edge thereof; and c. the rod means comprises a rod having a first end connected to the base for rotating about the second axis, and a second end rigidly attached to the lower reinforcement plate of the bottom plate; and d. the carrier means comprises:

i. a pair of lugs joined to the inside edge of the lower contact plate of the bottom plate; and ii. roller means held between the lugs for rolling along the handle.

5. The crusher for metal cans of claim 4 wherein the upper contact plate of the top plate and the lower contact plate of the bottom plate are formed with complimentary creases therein.

6. The crusher for metal cans of claim 4 wherein:

a. the upper contact plate of the top plate has a working surface that is creased so as to be convex; and b. the lower contact plate of the bottom plate has a working surface that is creased so as to be concave and to be complimentary to the working surface of the top plate upper contact plate.

7. The crusher for metal cans of claim 4 wherein the bottom plate approaches the top plate in a first step in response to pivoting of the handle from the first to the second positions thereof in which the outside edge of the bottom plate lower contact plate approaches the outside edge of the top plate upper contact plate faster than the inside edge of the bottom plate lower contact plate approaches the inside edge of the top plate upper contact plate, and in a second step in which the inside edge of the bottom plate lower contact plate approaches the inside edge of the top plate upper contact plate faster than the outside edge of the bottom plate lower contact plate approaches the outside edge of the top plate upper contact plate, the upper and lower contact plates being closely spaced and generally parallel to each other when the handle is in the second position thereof.

8. The crusher for metal cans of claim 4 wherein the bottom plate tilts relative to the top plate and to the handle as the handle pivots from the first to the second positions thereof, and wherein the top and bottom plates are generally parallel to each other when the handle is in the second position thereof.

9. The crusher for metal cans of claim 1 wherein the carrier means comprises a shackle that slides over the handle, the shackle having side arms that are joined to the bottom plate, the bottom plate cooperating with the shackle to capture and guide the shackle and bottom plate on the handle.

10. The crusher for metal cans of claim 9 wherein the rod means comprises a rod having a first end connected to the base for rotation about the base second axis, and a second end rotatably connected to the shackle arms.

11. Apparatus for crushing objects comprising:

a. base means for mounting to a selected surface;

b. a handle having a first end connected to the base means for pivoting between first and second positions about a first axis;

c. first plate means fixed to the handle for contacting a first side of an object;

d. second plate means movable along the handle for contacting a second side of the object to bring the object into contact with the first plate means; and e. rod means rotating about a second axis in response to pivoting the handle from the first to the second positions thereof for forcing the second plate means to move along the handle toward the first plate means to thereby crush the object between the first and second plate means.

12. The apparatus of claim 11 wherein:

a. the first plate means comprises a top plate fixed to the handle and being generally perpendicular thereto;

b. the second plate means comprises a bottom plate generally parallel to and aligned with the top plate; and c. the rod means comprises a rod having a first end that is connected to the base means for rotating about the second axis, and a second end that is rotatably connected to the bottom plate.

13. The apparatus of claim 12 wherein the second plate means further comprises sleeve means for guiding the bottom plate when the second plate means moves along the handle.

14. The apparatus of claim 11 wherein:

a. the first plate means comprises a top plate fixed to the handle and being generally perpendicular thereto;

b. the second plate means comprises:

i. a bottom plate; and ii. carrier means joined to the bottom plate for sliding along the handle and guiding the bottom plate to be generally parallel to and aligned with the top plate; and c. the rod means comprises a rod having a first end that is connected to the base means for rotating about the second axis, and a second end that is rotatably connected to the carrier means and the bottom plate.

15. The apparatus of claim 14 wherein:

a. the carrier means comprises a shackle that slidably receives the handle; and b. the bottom plate cooperates with the shackle to capture and guide the shackle and bottom plate on the handle.

16. The apparatus of claim 11 wherein:

a. the first plate means comprises:

i. an upper contact plate joined to the handle; and ii. an upper reinforcement plate joined to the upper contact plate and to the handle;

b. the second plate means comprises:

i. a lower contact plate;

ii. a lower reinforcement plate joined to the lower contact plate; and iii. guide means joined to the lower reinforcement plate for enabling the second plate means to slide along the handle; and c. the rod means comprises a rod having a first end connected to the base means for rotating about the second axis, and a second end rigidly attached to the second plate means.

17. The apparatus of claim 16 wherein the guide means comprises:

a. a pair of lugs joined to the bottom plate lower contact plate; and b. roller means held by the lug means for rolling along the handle.

18. The apparatus of claim 16 wherein:

a. the first plate means upper contact plate has an inside edge joined to the handle, an outside edge, and opposed side edges;

b. the second plate means lower contact plate has an inside edge joined to the handle and an outside edge; and c. the rod and the guide means cooperate to cause the outside edge of the second plate means lower contact plate to approach the outside edge of the first plate means upper contact plate faster than the inside edge of the second plate means lower contact plate approaches the inside edge of the first plate means upper contact plate during a first portion of the pivoting of the handle from the first to the second positions thereof, and to cause the inside edge of the second plate means lower contact plate to approach the inside edge of the first plate means upper contact plate faster than the outside edge of the second plate means lower contact plate approaches the outside edge of the first plate means upper contact plate during a second portion of the pivoting of the handle, so that the object is crushed between the first and second plate means in two steps.

19. The apparatus of claim 16 wherein the first plate means upper contact plate and the second plate means lower contact plate have respective working surfaces formed with complimentary creases therein.

20. The apparatus of claim 11 wherein the second plate means tilts in two steps relative to the first plate means as the rod means forces the second plate means toward the first plate means in response to pivoting of the handle from the first to the second positions thereof.

21. A method of crushing a can comprising the steps of:

a. pivotally connecting one end of a handle to a base;

b. fixing a top plate to the handle;

c. guiding a bottom plate on the handle;

d. rotatably connecting one end of a rod to the base and attaching of the rod to the bottom plate;

e. pivoting the handle to a first position whereat the top and bottom plates are spaced apart;

f. placing a can between the top and bottom plates; and g. pivoting the handle to a second position and simultaneously rotating the rod and forcing the bottom plate by the rod to guide along the handle toward the top plate and thereby crushing the can between the top and bottom plates.

22. The method of claim 21 wherein the step of rotating the rod and forcing the bottom plate toward the top plate comprises the step of tilting the bottom plate relative to the top plate in two steps as the bottom plate is guided toward the top plate.

23. The method of claim 21 wherein:

a. the step of fixing a top plate to the handle comprises the steps of:

i. providing an upper contact plate having an inside edge and an outside edge; and ii. joining the upper contact plate inside edge to the handle;

b. the step of guiding a second plate on the handle comprises the steps of:

i. providing a lower contact plate having an inside edge and an outside edge; and ii. guiding the lower contact plate inside edge on the handle; and c. the step of rotating the rod and forcing the bottom plate toward the top plate comprises the steps of:

i. tilting the bottom plate in a first step relative to the top plate such that the respective outside edges of the bottom plate lower contact plate and the top plate upper contact plate approach each other faster than the respective inside edges of the bottom plate lower contact plate and the top plate upper contact plate approach each other; and ii. tilting the bottom plate in a second step relative to the top plate such that the respective inside edges of the bottom plate lower contact plate and the top plate upper contact plate approach each other faster than the respective outside edges of the bottom plate lower contact plate and the top plate upper contact plate approach each other, so that the object is crushed in two steps.

* * * * *